US009161410B1

(12) United States Patent
Tsai et al.

(10) Patent No.: US 9,161,410 B1
(45) Date of Patent: Oct. 13, 2015

(54) LIGHT EMITTING DIODE DRIVING APPARATUS WITH VARIABLE OUTPUT CURRENT AND METHOD FOR THE SAME

(71) Applicant: Chicony Power Technology Co., Ltd., New Taipei (TW)

(72) Inventors: Chao-Wei Tsai, New Taipei (TW); Jyun-Ping Wang, New Taipei (TW); Hung-Ta Shih, New Taipei (TW)

(73) Assignee: CHICONY POWER TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/250,940

(22) Filed: Apr. 11, 2014

(51) Int. Cl.
*H05B 37/02* (2006.01)
*H05B 33/08* (2006.01)

(52) U.S. Cl.
CPC ..... *H05B 33/0845* (2013.01)

(58) Field of Classification Search
CPC ..... H05B 37/02; H05B 33/0845
USPC ..... 315/291, 299, 224, 297, 307
See application file for complete search history.

(56) References Cited

U.S. PATENT DOCUMENTS

2013/0141018 A1* 6/2013 Kamii ..... 315/360

* cited by examiner

*Primary Examiner* — Daniel D Chang
(74) *Attorney, Agent, or Firm* — Muncy, Geissler, Olds & Lowe, P.C.

(57) ABSTRACT

A pulse width modulation control unit multiplies a value of a user side setting signal by a value of a dimming signal to obtain a pulse width modulation output current control signal. The pulse width modulation control unit sends the pulse width modulation output current control signal to a light emitting diode driving unit. The light emitting diode driving unit multiplies a value of the pulse width modulation output current control signal by a value of a maximum output current of the light emitting diode driving unit to obtain a light emitting diode pulse width modulation driving current. The light emitting diode driving unit drives a light emitting diode by the light emitting diode pulse width modulation driving current.

9 Claims, 3 Drawing Sheets

LIGHT EMITTING DIODE DRIVING APPARATUS WITH VARIABLE OUTPUT CURRENT AND METHOD FOR THE SAME

BACKGROUND OF THE INVENTION

1. Field of the Invention

The present invention relates to a light emitting diode driving apparatus and a method for outputting current of the light emitting diode driving apparatus, and especially relates to a light emitting diode driving apparatus with variable output current and method for the same.

2. Description of the Related Art

Comparing to incandescent light sources, light emitting diodes have a lot of advantages, including lower energy consumption, longer life, improved physical endurance, smaller size and faster switching speed. Therefore, light emitting diodes are used widely to replace fluorescent lamps or tungsten lamps.

A light emitting diode driving apparatus is used to drive light emitting diodes. However, the disadvantage of the light emitting diode driving apparatus is that the output current of the light emitting diode driving apparatus is not changed easily. Generally speaking, the hardware of the light emitting diode driving apparatus has to be modified in order to change the output current of the light emitting diode driving apparatus.

SUMMARY OF THE INVENTION

In order to solve the above-mentioned problems, an object of the present invention is to provide a light emitting diode driving apparatus with variable output currents.

In order to solve the above-mentioned problems, another object of the present invention is to provide a light emitting diode driving apparatus with variable output currents.

In order to solve the above-mentioned problems, still another object of the present invention is to provide a method for changing an output current of a light emitting diode driving apparatus.

In order to achieve the object of the present invention mentioned above, the light emitting diode driving apparatus is applied to at least a light emitting diode and a user setting unit. The light emitting diode driving apparatus includes alight emitting diode driving unit, a pulse width modulation control unit and a dimming unit. The light emitting diode driving unit is electrically connected to the light emitting diode. The pulse width modulation control unit is electrically connected to the light emitting diode driving unit and the user setting unit. The dimming unit is electrically connected to the pulse width modulation control unit. The user setting unit sends a user side setting signal to the pulse width modulation control unit. The dimming unit sends a dimming signal to the pulse width modulation control unit. The pulse width modulation control unit multiplies a value of the user side setting signal by a value of the dimming signal to obtain a pulse width modulation output current control signal. The pulse width modulation control unit sends the pulse width modulation output current control signal to the light emitting diode driving unit. The light emitting diode driving unit multiplies a value of the pulse width modulation output current control signal by a value of a maximum output current of the light emitting diode driving unit to obtain a light emitting diode pulse width modulation driving current. The light emitting diode driving unit drives the light emitting diode by the light emitting diode pulse width modulation driving current.

In order to achieve the object of the present invention mentioned above, the light emitting diode driving apparatus is applied to at least a light emitting diode. The light emitting diode driving apparatus includes a user setting unit, a light emitting diode driving unit, a pulse width modulation control unit and a dimming unit. The light emitting diode driving unit is electrically connected to the light emitting diode. The pulse width modulation control unit is electrically connected to the light emitting diode driving unit and the user setting unit. The dimming unit is electrically connected to the pulse width modulation control unit. The user setting unit sends a user side setting signal to the pulse width modulation control unit. The dimming unit sends a dimming signal to the pulse width modulation control unit. The pulse width modulation control unit multiplies a value of the user side setting signal by a value of the dimming signal to obtain a pulse width modulation output current control signal. The pulse width modulation control unit sends the pulse width modulation output current control signal to the light emitting diode driving unit. The light emitting diode driving unit multiplies a value of the pulse width modulation output current control signal by a value of a maximum output current of the light emitting diode driving unit to obtain a light emitting diode pulse width modulation driving current. The light emitting diode driving unit drives the light emitting diode by the light emitting diode pulse width modulation driving current.

In order to achieve the object of the present invention mentioned above, the method for changing the output current of the light emitting diode driving apparatus is applied to the light emitting diode driving apparatus and at least a light emitting diode. The light emitting diode driving apparatus includes a user setting unit, a light emitting diode driving unit, a pulse width modulation control unit and a dimming unit. The method includes following steps. The user setting unit sends a user side setting signal to the pulse width modulation control unit. The dimming unit sends a dimming signal to the pulse width modulation control unit. The pulse width modulation control unit multiplies a value of the user side setting signal by a value of the dimming signal to obtain a pulse width modulation output current control signal. The pulse width modulation control unit sends the pulse width modulation output current control signal to the light emitting diode driving unit. The light emitting diode driving unit multiplies a value of the pulse width modulation output current control signal by a value of a maximum output current of the light emitting diode driving unit to obtain a light emitting diode pulse width modulation driving current. The light emitting diode driving unit drives the light emitting diode by the light emitting diode pulse width modulation driving current.

The efficiency of the present invention is to change the output current of the light emitting diode driving apparatus easily.

DETAILED DESCRIPTION OF THE INVENTION

Figure 1:
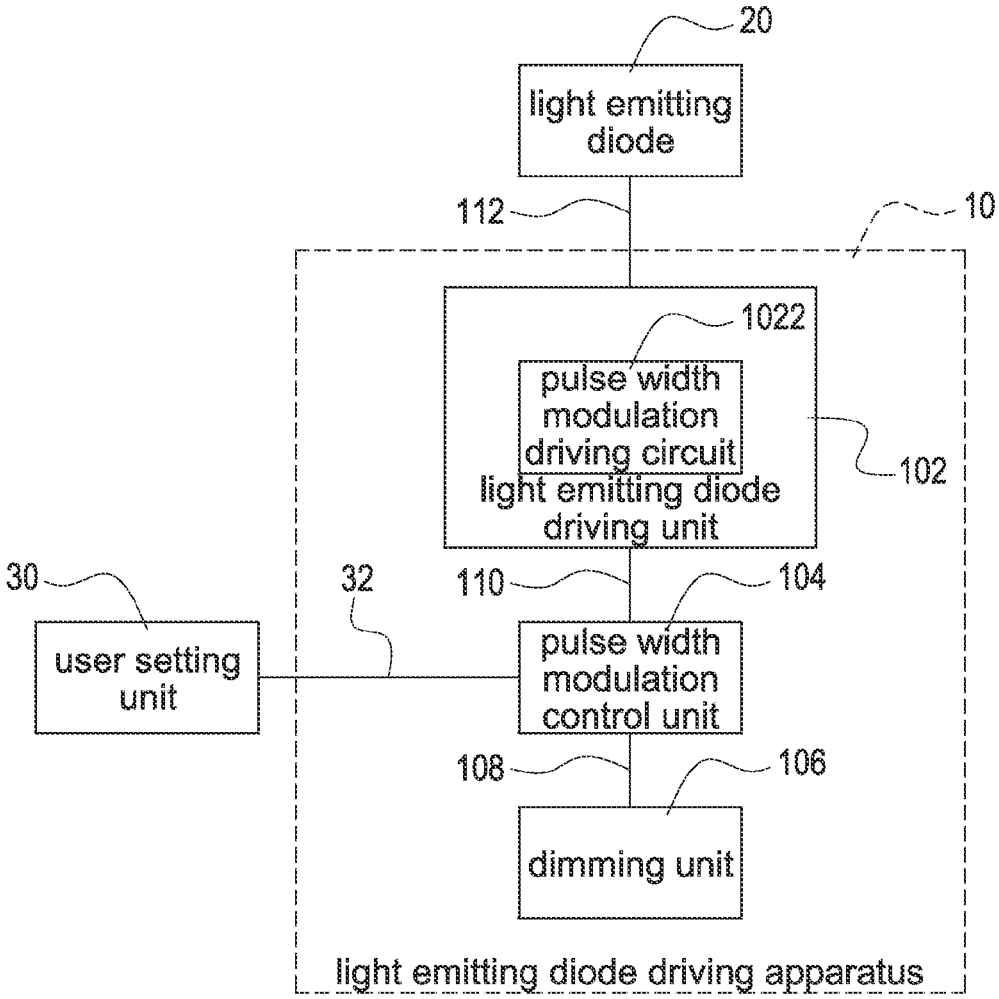
FIG. 1 shows a block diagram of the first embodiment of the light emitting diode driving apparatus of the present invention.

FIG. 1 shows a block diagram of the first embodiment of the light emitting diode driving apparatus of the present invention. A light emitting diode driving apparatus 10 with variable output currents is applied to at least a light emitting diode 20 and a user setting unit 30. The light emitting diode driving apparatus 10 includes a light emitting diode driving unit 102, a pulse width modulation control unit 104 and a dimming unit 106.

The light emitting diode driving unit 102 is electrically connected to the light emitting diode 20. The pulse width modulation control unit 104 is electrically connected to the light emitting diode driving unit 102 and the user setting unit 30. The dimming unit 106 is electrically connected to the pulse width modulation control unit 104.

The user setting unit 30 sends a user side setting signal 32 to the pulse width modulation control unit 104. The dimming unit 106 sends a dimming signal 108 to the pulse width modulation control unit 104. The pulse width modulation control unit 104 multiplies a value of the user side setting signal 32 by a value of the dimming signal 108 to obtain a pulse width modulation output current control signal 110.

For example, the value of the user side setting signal 32 is 0.9. The value of the dimming signal 108 is 0.9. Therefore, a value of the pulse width modulation output current control signal 110 is 0.81. The pulse width modulation output current control signal 110 is generated in the form of pulse width modulation. For example, the percentage of the conduction time is 81% and the percentage of the non-conduction time is 19% (namely, the duty cycle is 81%).

The pulse width modulation control unit 104 sends the pulse width modulation output current control signal 110 to the light emitting diode driving unit 102. The light emitting diode driving unit 102 multiplies a value of the pulse width modulation output current control signal 110 by a value of a maximum output current of the light emitting diode driving unit 102 to obtain a light emitting diode pulse width modulation driving current 112. The light emitting diode driving unit 102 drives the light emitting diode 20 by the light emitting diode pulse width modulation driving current 112.

For example, the value of the pulse width modulation output current control signal 110 is 0.81. The value of the maximum output current of the light emitting diode driving unit 102 is 2 amperes. Therefore, the light emitting diode pulse width modulation driving current 112 is 1.62 amperes.

Moreover, the light emitting diode driving unit 102 includes a pulse width modulation driving circuit 1022. The pulse width modulation driving circuit 1022 drives the light emitting diode 20 by the light emitting diode pulse width modulation driving current 112. The pulse width modulation control unit 104 is, for example but not limited to, a multiplier or a microprocessor.

Moreover, the pulse width modulation output current control signal 110 is different from the light emitting diode pulse width modulation driving current 112. The light emitting diode pulse width modulation driving current 112 is used to drive the light emitting diode 20. A frequency of the light emitting diode pulse width modulation driving current 112 is usually between 60 KHz and 70 KHz (high frequency). The pulse width modulation output current control signal 110 is used to control the percentage of the maximum output current of the light emitting diode driving unit 102. A frequency of the pulse width modulation output current control signal 110 is usually between 100 Hz and 10 KHz.

Figure 2:
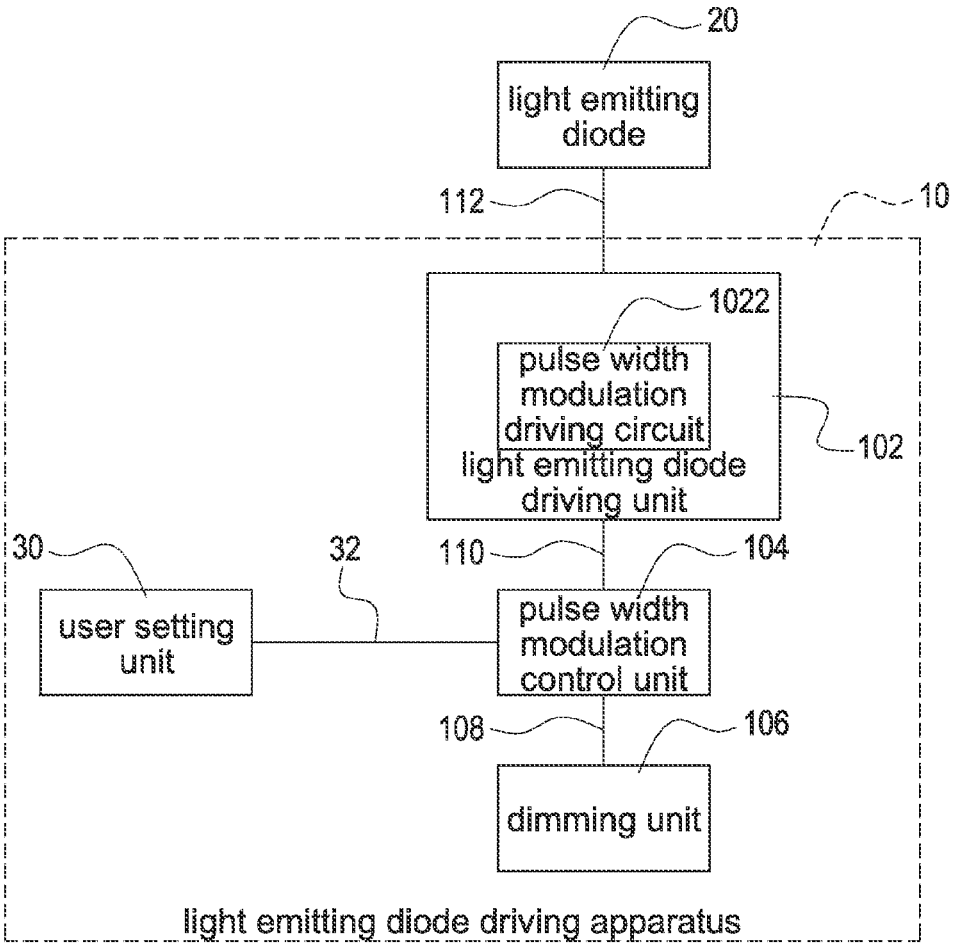
FIG. 2 shows a block diagram of the second embodiment of the light emitting diode driving apparatus of the present invention.

FIG. 2 shows a block diagram of the second embodiment of the light emitting diode driving apparatus of the present invention. A light emitting diode driving apparatus 10 with variable output current is applied to at least a light emitting diode 20. The light emitting diode driving apparatus 10 includes a user setting unit 30, a light emitting diode driving unit 102, a pulse width modulation control unit 104 and a dimming unit 106.

The light emitting diode driving unit 102 is electrically connected to the light emitting diode 20. The pulse width modulation control unit 104 is electrically connected to the light emitting diode driving unit 102 and the user setting unit 30. The dimming unit 106 is electrically connected to the pulse width modulation control unit 104.

The user setting unit 30 sends a user side setting signal 32 to the pulse width modulation control unit 104. The dimming unit 106 sends a dimming signal 108 to the pulse width modulation control unit 104. The pulse width modulation control unit 104 multiplies a value of the user side setting signal 32 by a value of the dimming signal 108 to obtain a pulse width modulation output current control signal 110.

For example, the value of the user side setting signal 32 is 0.9. The value of the dimming signal 108 is 0.9. Therefore, a value of the pulse width modulation output current control signal 110 is 0.81. The pulse width modulation output current control signal 110 is generated in the form of pulse width modulation. For example, the percentage of the conduction time is 81% and the percentage of the non-conduction time is 19% (namely, the duty cycle is 81%).

The pulse width modulation control unit 104 sends the pulse width modulation output current control signal 110 to the light emitting diode driving unit 102. The light emitting diode driving unit 102 multiplies a value of the pulse width modulation output current control signal 110 by a value of a maximum output current of the light emitting diode driving unit 102 to obtain a light emitting diode pulse width modulation driving current 112. The light emitting diode driving unit 102 drives the light emitting diode 20 by the light emitting diode pulse width modulation driving current 112.

For example, the value of the pulse width modulation output current control signal 110 is 0.81. The value of the maximum output current of the light emitting diode driving unit 102 is 2 amperes. Therefore, the light emitting diode pulse width modulation driving current 112 is 1.62 amperes.

Moreover, the light emitting diode driving unit 102 includes a pulse width modulation driving circuit 1022. The pulse width modulation driving circuit 1022 drives the light emitting diode 20 by the light emitting diode pulse width modulation driving current 112. The pulse width modulation control unit 104 is, for example but not limited to, a multiplier or a microprocessor.

Moreover, the pulse width modulation output current control signal 110 is different from the light emitting diode pulse width modulation driving current 112. The light emitting diode pulse width modulation driving current 112 is used to drive the light emitting diode 20. A frequency of the light emitting diode pulse width modulation driving current 112 is usually between 60 KHz and 70 KHz (high frequency). The pulse width modulation output current control signal 110 is used to control the percentage of the maximum output current of the light emitting diode driving unit 102. A frequency of the pulse width modulation output current control signal 110 is usually between 100 Hz and 10 KHz.

Figure 3:
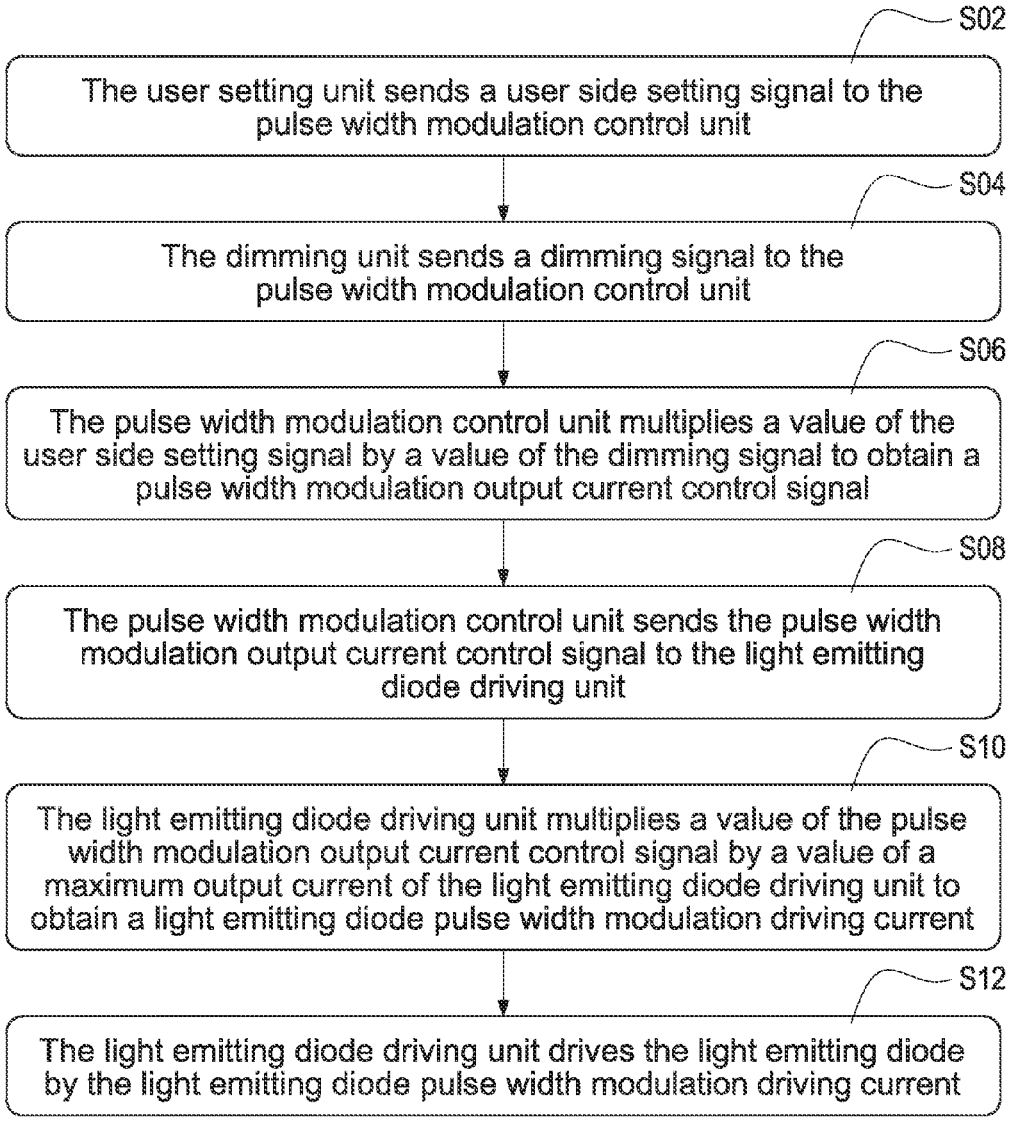
FIG. 3 shows a flow chart for changing the output current of the light emitting diode driving apparatus of the present invention.

FIG. 3 shows a flow chart for changing the output current of the light emitting diode driving apparatus of the present invention. A method for changing an output current of a light emitting diode driving apparatus is applied to the light emitting diode driving apparatus and at least a light emitting diode. The light emitting diode driving apparatus includes a user setting unit, a light emitting diode driving unit, a pulse width modulation control unit and a dimming unit. The method includes following steps.

S02: The user setting unit sends a user side setting signal to the pulse width modulation control unit.

S04: The dimming unit sends a dimming signal to the pulse width modulation control unit.

S06: The pulse width modulation control unit multiplies a value of the user side setting signal by a value of the dimming signal to obtain a pulse width modulation output current control signal.

For example, the value of the user side setting signal is 0.9. The value of the dimming signal is 0.9. Therefore, a value of the pulse width modulation output current control signal is 0.81. The pulse width modulation output current control signal is generated in the form of pulse width modulation. For example, the percentage of the conduction time is 81% and the percentage of the non-conduction time is 19% (namely, the duty cycle is 81%).

S08: The pulse width modulation control unit sends the pulse width modulation output current control signal to the light emitting diode driving unit.

S10: The light emitting diode driving unit multiplies a value of the pulse width modulation output current control signal by a value of a maximum output current of the light emitting diode driving unit to obtain a light emitting diode pulse width modulation driving current.

S12: The light emitting diode driving unit drives the light emitting diode by the light emitting diode pulse width modulation driving current.

For example, the value of the pulse width modulation output current control signal is 0.81. The value of the maximum output current of the light emitting diode driving unit is 2 amperes. Therefore, the light emitting diode pulse width modulation driving current is 1.62 amperes.

Moreover, the light emitting diode driving unit includes a pulse width modulation driving circuit. The pulse width modulation driving circuit drives the light emitting diode by the light emitting diode pulse width modulation driving current. The pulse width modulation control unit is, for example but not limited to, a multiplier or a microprocessor.

Moreover, the pulse width modulation output current control signal is different from the light emitting diode pulse width modulation driving current. The light emitting diode pulse width modulation driving current is used to drive the light emitting diode. A frequency of the light emitting diode pulse width modulation driving current is usually between 60 KHz and 70 KHz (high frequency). The pulse width modulation output current control signal is used to control the percentage of the maximum output current of the light emitting diode driving unit. A frequency of the pulse width modulation output current control signal is usually between 100 Hz and 10 KHz.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting diode driving apparatus applied to at least a light emitting diode and a user setting unit, the light emitting diode driving apparatus comprising:

a light emitting diode driving unit electrically connected to the light emitting diode;

a pulse width modulation control unit electrically connected to the light emitting diode driving unit and the user setting unit; and a dimming unit electrically connected to the pulse width modulation control unit, wherein the user setting unit sends a user side setting signal to the pulse width modulation control unit; the dimming unit sends a dimming signal to the pulse width modulation control unit; the pulse width modulation control unit multiplies a value of the user side setting signal by a value of the dimming signal to obtain a pulse width modulation output current control signal; the pulse width modulation control unit sends the pulse width modulation output current control signal to the light emitting diode driving unit; the light emitting diode driving unit multiplies a value of the pulse width modulation output current control signal by a value of a maximum output current of the light emitting diode driving unit to obtain a light emitting diode pulse width modulation driving current; the light emitting diode driving unit drives the light emitting diode by the light emitting diode pulse width modulation driving current; the user side setting signal is less than 1; the pulse width modulation output current control signal is used to control a percentage of the maximum output current of the light emitting diode driving unit.

2. The light emitting diode driving apparatus in claim 1, wherein the light emitting diode driving unit comprises a pulse width modulation driving circuit; the pulse width modulation driving circuit drives the light emitting diode by the light emitting diode pulse width modulation driving current.

3. The light emitting diode driving apparatus in claim 2, wherein the pulse width modulation control unit is a multiplier or a microprocessor.

4. A light emitting diode driving apparatus applied to at least a light emitting diode, the light emitting diode driving apparatus comprising:

a user setting unit;

a light emitting diode driving unit electrically connected to the light emitting diode;

a pulse width modulation control unit electrically connected to the light emitting diode driving unit and the user setting unit; and a dimming unit electrically connected to the pulse width modulation control unit, wherein the user setting unit sends a user side setting signal to the pulse width modulation control unit; the dimming unit sends a dimming signal to the pulse width modulation control unit; the pulse width modulation control unit multiplies a value of the user side setting signal by a value of the dimming signal to obtain a pulse width modulation output current control signal; the pulse width modulation control unit sends the pulse width modulation output current control signal to the light emitting diode driving unit; the light emitting diode driving unit multiplies a value of the pulse width modulation output current control signal by a value of a maximum output current of the light emitting diode driving unit to obtain a light emitting diode pulse width modulation driving current; the light emitting diode driving unit drives the light emitting diode by the light emitting diode pulse width modulation driving current; the user side setting signal is less than 1; the pulse width modulation output current control signal is used to control a percentage of the maximum output current of the light emitting diode driving unit.

5. The light emitting diode driving apparatus in claim 4, wherein the light emitting diode driving unit comprises a pulse width modulation driving circuit; the pulse width modulation driving circuit drives the light emitting diode by the light emitting diode pulse width modulation driving current.

6. The light emitting diode driving apparatus in claim 5, wherein the pulse width modulation control unit is a multiplier or a microprocessor.

7. A method for changing an output current of a light emitting diode driving apparatus, the method applied to the light emitting diode driving apparatus and at least a light emitting diode, the light emitting diode driving apparatus comprising a user setting unit, a light emitting diode driving unit, a pulse width modulation control unit and a dimming unit, the method comprising:

sending a user side setting signal to the pulse width modulation control unit by the user setting unit;

sending a dimming signal to the pulse width modulation control unit by the dimming unit;

multiplying a value of the user side setting signal by a value of the dimming signal to obtain a pulse width modulation output current control signal by the pulse width modulation control unit;

sending the pulse width modulation output current control signal to the light emitting diode driving unit by the pulse width modulation control unit;

multiplying a value of the pulse width modulation output current control signal by a value of a maximum output current of the light emitting diode driving unit to obtain a light emitting diode pulse width modulation driving current by the light emitting diode driving unit; and driving the light emitting diode by the light emitting diode driving unit with the light emitting diode pulse width modulation drilling current; the user side setting signal is less than 1; the pulse width modulation output current control signal is used to control a percentage of the maximum output current of the light emitting diode driving unit.

8. The method in claim 7, wherein the light emitting diode driving unit comprises a pulse width modulation driving circuit; the pulse width modulation driving circuit drives the light emitting diode by the light emitting diode pulse width modulation driving current.

9. The method in claim 8, wherein the pulse width modulation control unit is a multiplier or a microprocessor.

* * * * *